US007161605B2

(12) United States Patent
Shimazu et al.

(10) Patent No.: US 7,161,605 B2
(45) Date of Patent: Jan. 9, 2007

(54) DISPLAY DEVICE FOR CONSTRUCTION MACHINE

(75) Inventors: Mitsuhiro Shimazu, Hiratsuka (JP); Masamichi Ueda, Tokyo (JP); Kenji Kooriyama, Hirakata (JP); Yuuichi Iwamoto, Neyagawa (JP)

(73) Assignee: Komatsu Ltd., Tokyo (JP)

( * ) Notice: Subject to any disclaimer, the term of this patent is extended or adjusted under 35 U.S.C. 154(b) by 81 days.

(21) Appl. No.: 09/912,308

(22) Filed: Jul. 26, 2001

(65) Prior Publication Data

US 2002/0015018 A1 Feb. 7, 2002

(30) Foreign Application Priority Data

Jul. 31, 2000 (JP) ..... 2000-231331

(51) Int. Cl.
*G09G 5/04* (2006.01)

(52) U.S. Cl. ..... 345/619

(58) Field of Classification Search ..... 345/589–605, 345/207, 7, 619; 349/29–30; 382/173; 348/586

See application file for complete search history.

(56) References Cited

U.S. PATENT DOCUMENTS 4,589,022 A * 5/1986 Prince et al. ..... 348/602
4,847,603 A * 7/1989 Blanchard ..... 345/7
4,952,917 A 8/1990 Yabuuchi
5,211,463 A * 5/1993 Kalmanash ..... 362/26
5,270,818 A * 12/1993 Ottenstein ..... 348/602
5,289,297 A * 2/1994 Bollman et al. ..... 358/537
5,399,947 A * 3/1995 Washburn ..... 315/383
5,430,809 A * 7/1995 Tomitaka ..... 382/173
5,764,139 A * 6/1998 Nojima et al. ..... 340/461
5,847,704 A * 12/1998 Hartman ..... 715/764
5,852,673 A * 12/1998 Young ..... 382/164
5,887,365 A * 3/1999 Fujishima et al. ..... 37/348
5,952,992 A * 9/1999 Helms ..... 345/102

(Continued)

FOREIGN PATENT DOCUMENTS

JP 9-209418 A 8/1997

OTHER PUBLICATIONS

Visual data interpretation, Joanna R. Alexander, SPIE-the international society for optical engineering, vol. 1668; pp. 61-72; 1992.*

*Primary Examiner*—Kee M. Tung
*Assistant Examiner*—J. Amini
(74) *Attorney, Agent, or Firm*—Posz Law Group, PLC; R. Eugene Varndell, Jr.

(57) ABSTRACT

A display device that has a display screen is disclosed that has the ability to prevent reflections of the display screen from appearing on glass, without lowering the visibility of a display portion of the display screen. The brightness of the display color of either the background portion 31 on a display screen 30 or the background portion 31 of such one of display portions 32 and 33 as occupies the larger area of the lit portion of the display screen 30 is changed according to the control of a control switch 23. If the brightness of the display color of the background portion 31 is lowered (from the "thin light blue" to the "thick light blue", for example) at the nighttime, its reflection on the glass around a cabin 40 can be reduced without lowering the luminance of the display screen 30. Alternatively, the saturation or hue of the display color can be changed to obtain a similar effect.

7 Claims, 4 Drawing Sheets

U.S. PATENT DOCUMENTS 6,094,185 A * 7/2000 Shirriff ..... 345/102
6,124,825 A * 9/2000 Eschenbach ..... 342/357.08
6,125,145 A * 9/2000 Koyanagi et al. ..... 375/240.16
6,160,666 A * 12/2000 Rallison et al. ..... 359/630
6,169,948 B1 * 1/2001 Fujishima et al. ..... 701/50
6,232,932 B1 * 5/2001 Thorner ..... 345/1.3
6,269,195 B1 * 7/2001 Gonsalves et al. ..... 382/284
6,271,825 B1 * 8/2001 Greene et al. ..... 345/694
6,392,612 B1 * 5/2002 George ..... 345/20
6,392,616 B1 * 5/2002 Suzuki et al. ..... 345/60
6,407,663 B1 * 6/2002 Huggett ..... 340/461
6,466,235 B1 * 10/2002 Smith et al. ..... 715/771
6,618,045 B1 * 9/2003 Lin ..... 345/207
6,668,078 B1 * 12/2003 Bolle et al. ..... 382/164
6,674,485 B1 * 1/2004 Akiyama et al. ..... 348/586
6,690,351 B1 * 2/2004 Wong ..... 345/156

* cited by examiner

DISPLAY DEVICE FOR CONSTRUCTION MACHINE

BACKGROUND OF THE INVENTION

1. Field of the Invention

The present invention relates to a device for changing the difference in the brightness, saturation or hue on the screen of a display device 10 disposed in the cabin of a construction machine.

2. Related Art

The cabin of the construction machine is provided with the display device. The display device has a display screen composed of a background portion and a display portion. The display portion is exemplified by bar graphs for indicating numerals such as the residual of a fuel, the water temperature, the oil temperature, the oil pressure or the battery voltage, and by caution marks for indicating abnormal conditions. Here, the "caution marks" imply the aforementioned abnormal conditions in a narrow sense. However, the "caution marks", as termed herein, imply a wide sense containing a pilot indication such as the parking brake indication or the preheat indication, or a message indication (in letters) . The operator can be informed of the internal state of the construction machine or an abnormal state having occurred in the construction machine by monitoring the display portion on the screen. When the caution mark or marks are turned ON, the operator can recognize the abnormality of the construction machine.

FIG. 2A is a perspective view showing the exterior of a cabin 40 of the construction machine. FIG. 2B shows a monitor panel 10 disposed inside of the cabin 40.

The cabin 40 of the construction machine is surrounded by wide glass areas at its front and back and at its right and left so that a wide field of view is retained. This retention is made to improve the working efficiency and the safety of the construction machine.

On the other hand, the monitor panel 10 is not surrounded by the dash board or the like but is exposed to the outside. This is because an excessive equipment in the cabin 40 will obstruct the field of view.

Here, the cabin 40 shown in FIG. 2A is provided with a roof and with glass shields on its front and back and on its right and left. In another mode, the cabin is provided with neither roof nor glass shield or with a glass shield only on the righthand side (as located on the side of the monitor panel 10, as shown).

In the daytime works, the construction machine is accompanied by the following problems.

At the daytime, the inside of the cabin 40 is exposed directly to the daylight, and so is the display screen 30 of the monitor panel 10. Then, the display screen 30 is not clear in contrast among a background portion 31, bar graphs 32 and caution marks 33 so that it reduces the visibility. This visibility reduction is serious especially in the display screen 30 in the construction machine having no roof in the cabin.

On the other hand, the construction having the glass shields around the cabin 40 is accompanied by the following problems when it is operated at the nighttime.

At the nighttime, the display screen 30 is easily reflected on the glass shields around the cabin 40 by the light emitted from the display screen 30 of the monitor panel 10. These reflections on the display screen 30 of the cabin 40 at the nighttime are caused by the difference between the illuminances of the exterior and the interior of the cabin 40. The images of the display screen 30, as reflected on the glass shields, will obstruct the field of view of the operator to raise a problem that the safe maneuvering is troubled.

If the luminance of the display screen 30 is lowered, the problem of the reflection of the display screen 30 on the glass shields can be solved, but the visibility of the display screen 30 is lowered.

SUMMARY OF THE INVENTION

Therefore, the present invention has an object to prevent the visibility of the display portion from being lowered and the display screen from being reflected on the glass shields.

According to a first aspect of the invention, there is provided a display device disposed in a cabin of a construction machine and comprising: a background portion, a display portion on a display screen, and change means for changing the difference in brightness, saturation or hue between the individual display colors of said background portion and said display portion.

According to the first aspect, the brightness, saturation or hue of the display colors of any of the background portion 31 or the display portions (i.e., the bar graphs and the caution marks) 32 and 33 of the display screen 30 is changed, as shown in FIG. 1B, according to the control of the control switch 23 to change the difference (or contrast) of the display color.

If the brightness of the display color of the background portion 31 is lowered (from the "thin light blue" to the "thick light blue", for example) at the nighttime, therefore, the reflection on the glass shields around the cabin 40 can be reduced without lowering the luminance of the display screen 30.

If the brightness of the display color of the background portion 31 is enhanced (from the "thick light blue" to the "thin light blue", for example) at the daytime, on the other hand, the contrast in the display color between the background portion 31 and the display portions (i.e., the bar graphs and the caution marks) 32 and 33 becomes excellent so that the display portions (i.e., the bar graphs 32 and the caution marks) 32 and 33 can be easily observed.

According to the first aspect, therefore, it is possible to prevent the visibility of the display portions (i.e., the bar graphs and the caution marks) 32 and 33 from becoming lower and the display screen 30 from being reflected on the glass shields.

In the first aspect of the invention, according to a second aspect, said change means changes the brightness, saturation or hue of such one of the display colors of said background portion and said display portion as occupies the larger area on said display screen.

Of the background portion 31 and the display portions (i.e., the bar graphs and the caution marks) 32 and 33, the portion occupying the larger area in the display screen 30, i.e., the portion having the larger display area is changed in the brightness, saturation or hue of the display color. As a result, it is further possible than in the first aspect to prevent the visibility of the display portions (i.e., the bar graphs and the caution marks) 32 and 33 from becoming lower and to prevent the display screen 30 from being reflected on the glass shields.

In the first aspect of the invention, according to a third aspect, said change means changes the brightness, saturation or hue of the display color of said background portion.

If the bar graphs 32 and the caution marks 33 are changed in the brightness of their color, they may become hardly visible. In the third aspect, therefore, there is changed the display color of the background portion 31. Therefore, effects similar to those of the first aspect can be obtained.

Where many display colors are used for displaying the bar graphs 32 and the caution marks 33, on the other hand, the control for changing the brightness of the display colors is complicated. The control for changing the brightnesses of the display colors is facilitated by changing the brightness of the background portion 31 having a smaller number of display colors.

In the first aspect of the invention, according to a fourth aspect, the display device further comprises:

an illumination switch for turning ON/OFF an illumination, wherein response to the ON/OFF of said illumination switch, the brightness, saturation or hue of either the display color of said background portion or said display portion or the display colors of said background portion and said display portion is changed.

According to the fourth aspect, when the floodlight of the display device or the headlight and the working light are turned ON by the illumination switch, the brightness, saturation or hue of the background portion 31 or the display portions 32 and 33 or the display colors of the background portion 31 or the display portions 32 and 33 is changed, and the contrast of each display color of the background portion 31 and the display portions 31 and 32 is changed. Therefore, effects similar to those of the first aspect are obtained.

On the other hand, it is unnecessary to change the contrast of the individual display colors of the background portion 31 and the display portions 32 and 33 independently. The operator is not required to interrupt the work for changing the contrast of each display color. Therefore, the work can be continued to prevent their efficiency from dropping.

According to a fifth aspect of the invention, there is provided a display device disposed in a cabin of a construction machine and comprising: a background portion, a display portion on a display screen, and illuminance detecting means for detecting the illuminance of the inside or the outside of the cabin; and change means for changing the difference in brightness, saturation or hue between the individual display colors of said background portion ad said display portion, depending on the case where the illuminance detected by said illuminance detecting means is higher or lower than a predetermined threshold value.

According to the fifth aspect, the illuminance of the interior or exterior of the cabin 40 is detected by the illuminance detecting means (e.g., an optical sensor). When at the nighttime the detected illuminance is lower than the threshold value, therefore, the brightness of the display colors of any (e.g., the background portion 31) of the background portion 31 or the display portions (i.e., the bar graphs and the caution marks) 32 and 33 of the display screen 30 is changed to the lower level. As a result, it is possible to reduce the reflection of the display screen 30 from being reflected on the glass shields around the cabin 40.

When at the daytime the detected illuminance is higher than the threshold value, therefore, the brightness of the display color of any (e.g., the background portion 31) of the background portion 31 or the display portions (i.e., the bar graphs and the caution marks) 32 and 33 of the display screen 30 is changed to the higher level. If the brightness of the display color of the background portion 31 on the screen 30 remains low at the daytime, more specifically, the contrast between the display color of the background portion 31 on the display screen 30 and the display color of the bar graphs 32 or the caution marks 33 is visually deteriorated by the high illuminance outside of the cockpit 40 so that the bar graphs 32 or the caution marks 33 on the display screen 30 are hard to observe. If the brightness of the display color of the background portion 31 on the screen 30 is made high at the daytime, the contrast is visually improved to make the display portions 32 and 33 easily observable. Alternatively, the saturation or hue may be arbitrarily changed.

BRIEF DESCRIPTION OF THE DRAWINGS

FIG. 1A is a diagram showing the exterior of a monitor panel 10, at a time other than the nighttime, and FIG. 1B is a diagram showing the exterior of the monitor panel 10 at the nighttime;

DESCRIPTION OF THE PREFERRED EMBODIMENT

An embodiment of the display device of a construction machine according to the invention will be described with reference to the accompanying drawings.

Figure 2A:
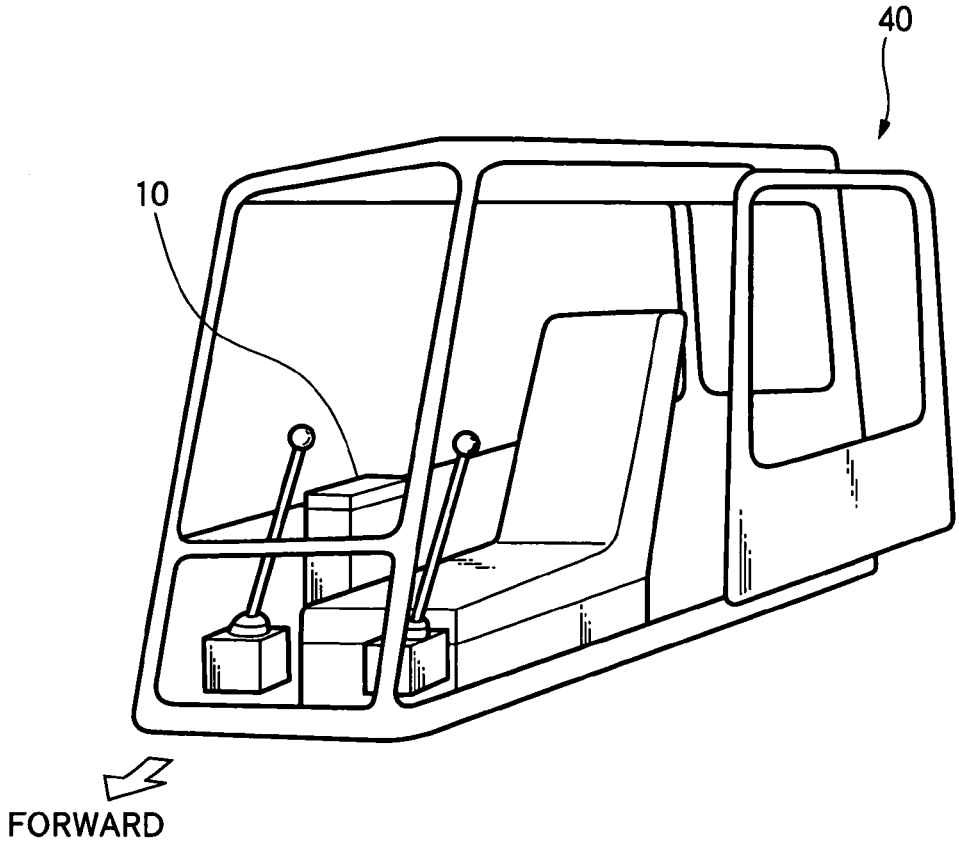
FIG. 2A is a perspective view showing the exterior of a cabin 40 of a construction machine.
Figure 2B:
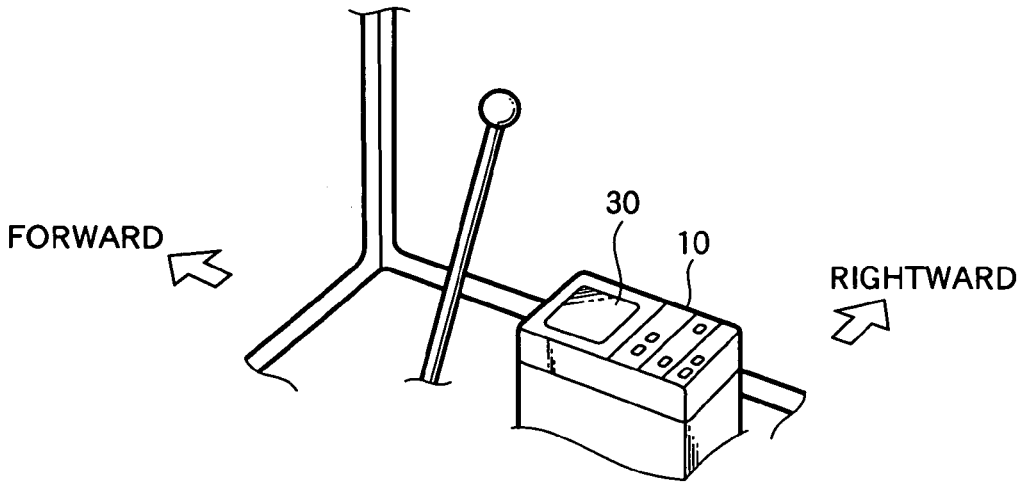
FIG. 2B is a diagram showing the interior of the cabin 40.
Figure 3:
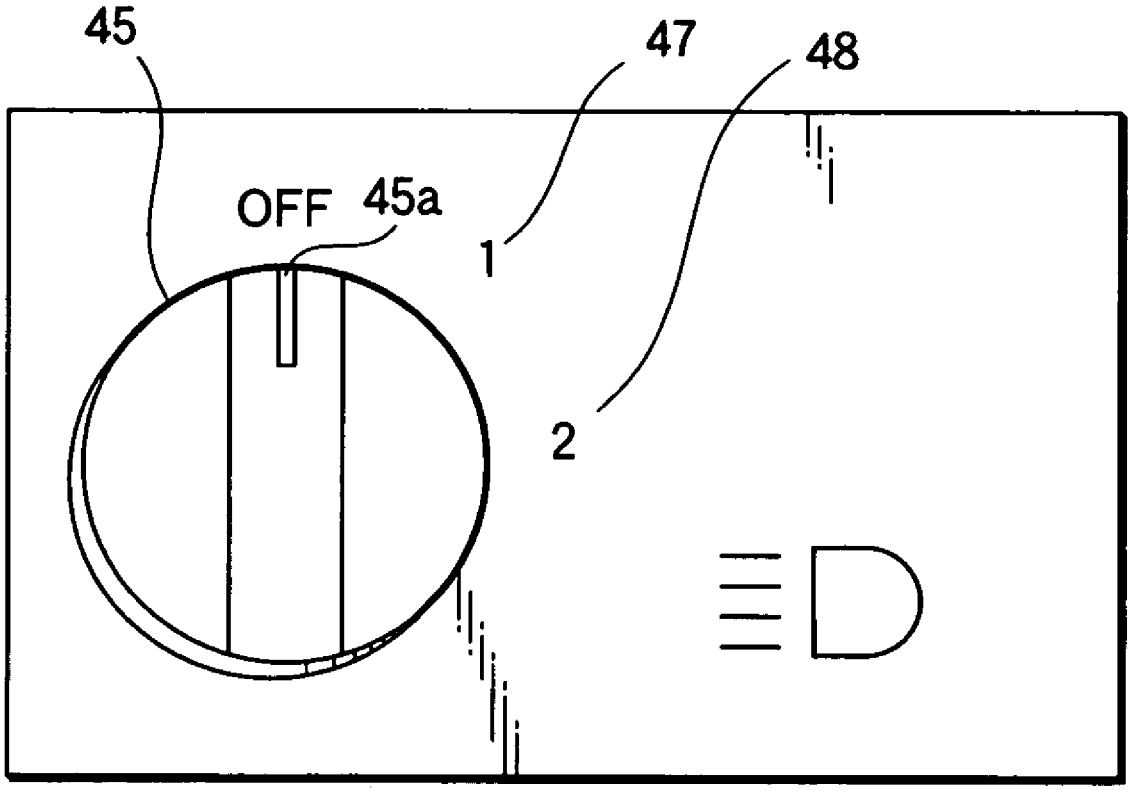
FIG. 3 is a diagram showing the exterior of one example of an illumination switch.

As shown in FIG. 2, a monitor panel 10 of this embodiment is disposed in a cabin 40 of a construction machine. On the other hand, the cabin 40 is provided therein with an illumination switch 45, as shown in FIG. 3. Where the indicator 45*a* of the illumination switch 45 indicates a first switch position 46, all the floodlight of the display device, the headlight and the working light of the construction machine are OFF. Where the indicator 45*a* of the illumination switch 45 indicates a second switch position 47, the floodlight of the display device is ON to illuminate the display device. In this case, on the other hand, the headlight and the working light of the construction machine are OFF. Where the indicator 45*a* of the illumination switch 45 indicates a third switch position 48, not only the floodlight of the display device but also the headlight and the working light of the construction machine are turned ON.

Figure 1B:
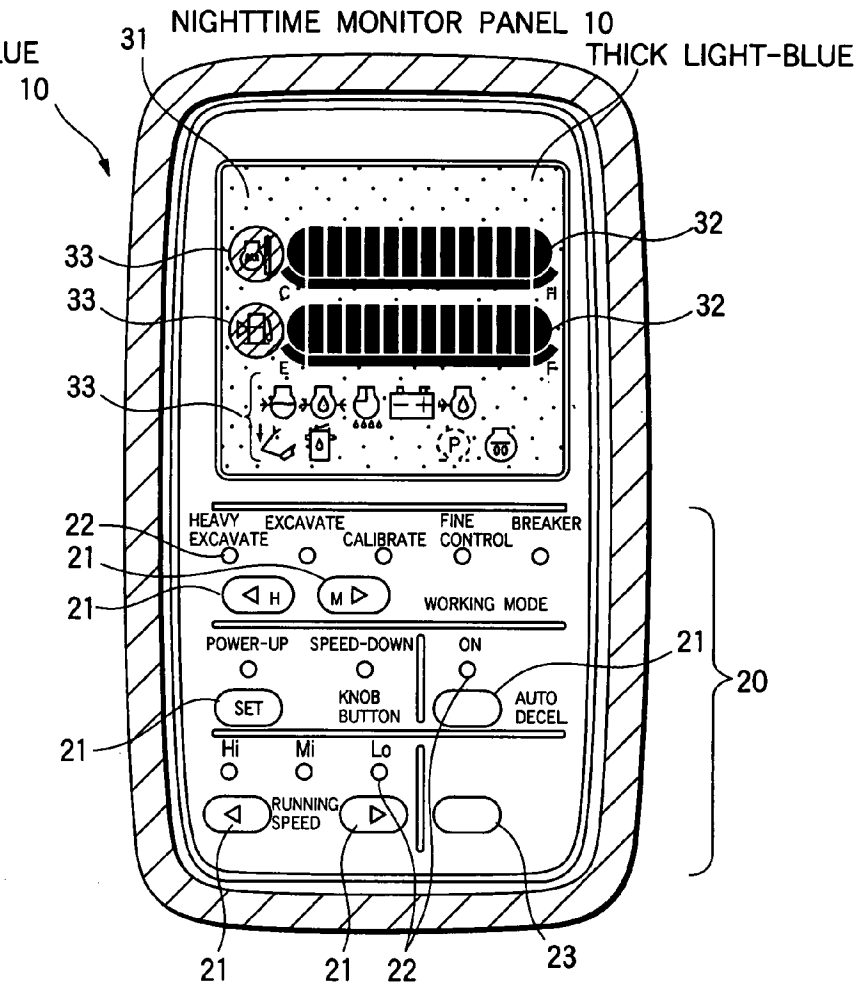
FIGS. 1A and 1B show exteriors of a monitor panel of an embodiment, where
Figure 1A:
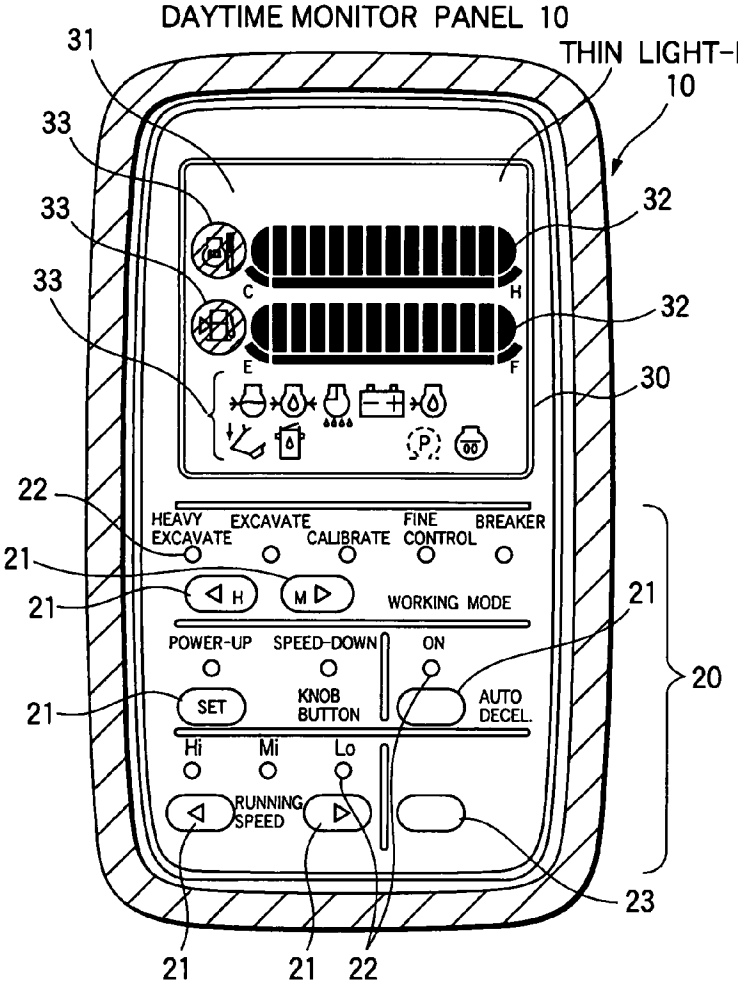

FIG. 1 shows the exterior of the display device 10 of the embodiment. The display device 10 of the embodiment has a display screen 30 and a control unit 20 integrated, and is called the "monitor panel 10". FIG. 1A shows the exterior of the monitor panel 10 at the daytime, and FIG. 1B shows the exterior of the monitor panel 10 at the nighttime.

The display screen 30 is composed of a background portion 31, bar graphs 32 and caution marks 33. In the background portion 31, more specifically, the bar graphs 32 and the caution marks 33 are arranged as the display portions. Here, the bar graphs 32 are display portions for indicating, when turned ON, the numerical values of the water temperature and the fuel residual. On the other hand, the caution marks 33 are display portions for indicating, when turned ON, the abnormal conditions of the water temperature, the fuel residual, the oil temperature, the oil pressure and the battery voltage. The background portion 31, the bar graphs 32 and the caution marks 33 are lit in different display colors. Here, the "caution marks" imply the aforementioned abnormal displays in a narrow sense. However, the "caution marks" to be used hereinafter are deemed to have a wide sense containing the parking brake indication, the pilot indication such as the preheat indication, and the message indication (in letters).

In the monitor panel 10 of FIG. 1, the background portion 31 occupies one half or more of the area of the display screen 30. In other words, in the display screen 30, the area occupied by the background portion 31 is larger than that occupied by the bar graphs 32 and the caution marks 33.

For the display screen 30, there can be used the dot-matrix LCD (or dot-matrix type Liquid Crystal Display), the EL (or Electro-Luminescence) or the LED (or Light Emitting Diode). This embodiment imagines the liquid crystal display. By controlling the liquid crystal display device, therefore, the background portion 31, the bar graphs 32 and the caution marks 33 on the display screen 30 are discriminated and displayed in display colors of different hues (e.g., light blue, green and red). This embodiment is characterized, as will be described hereinafter, in that the display color of the background portion 31 is displayed in a brightness different from those of the bar graphs 32 and the caution marks 33 to change the brightness difference (or contrast) between the background portion 31, and the bar graphs 32 and the caution marks 33. The "brightness" used here implies the brightness as one of the three primaries of colors.

In this embodiment, there is imagined the color liquid crystal display screen 30 which can display the background portion 31, the bar graphs 32 and the caution marks 33 in the chromatic colors (i.e., the light blue, green and red colors) However, these background portion 31, bar graphs 32 and caution marks 33 may be displayed in the achromatic colors (i.e., the white, grey and black colors).

The monitor panel 10 is provided on its control unit 20 with a plurality of select switches 21, a plurality of indication lamps 22 and a brightness changing switch 23.

The select switches 21 output signals of different contents according to the number of depressions to the control device of the construction machine. When the select switch 21 for the working mode is selectively controlled to the "heavy excavate", for example, a signal commanding the heavy excavation is outputted to the control device so that the speed of the engine and the discharge of the hydraulic pump are controlled to fit the heavy excavation. The indication lamp 22 indicates the content, as selected by the select switch 21, when turned ON. When the select switch 21 for the working mode is selectively controlled to the "heavy excavate", for example, the indication lamp 22 corresponding to the "heavy excavate" is turned ON.

The brightness changing switch 23 changes the brightness of the background portion 31 of the display screen 30 at two stages.

Each time the brightness changing switch 23 is pushed, there are alternately selected a higher brightness and a lower brightness. When the brightness changing switch 23 is pushed for the higher brightness of the background portion 31, a signal instructing the lower brightness is outputted to the liquid crystal drive device. As a result, the brightness of the display color of the background portion 31 is changed to the lower one. For example, the background portion 31 is changed from the "thin light blue" to the "thick light blue". When the brightness changing switch 23 is pushed for the lower brightness of the background portion 31, on the other hand, a signal instructing the higher brightness is outputted to the liquid crystal drive device. As a result, the brightness of the display color of the background portion 31 is changed to the higher one. For example, the background portion 31 is changed from the "thick light blue" to the "thin light blue". When the brightness of the background portion 31 is thus changed, its difference is changed between the background portion 31, and the bar graphs 32 and the caution marks 33.

Here will be described the actions of the monitor panel 10 of FIG. 1.

It is now assumed that the display color of the background portion 31 of the display screen 30 is the "thin light blue", as shown in FIG. 1A.

When the brightness of the outside of the cabin 40 drops at the nighttime, there arises a difference between the brightness of the outside of the cabin 40 and the brightness of the inside of the cabin 40. As a result, the background portion 31 occupying most of the display area of the display screen 30 has a high brightness of the "thin light blue" so that the display screen 30 is easily reflected on the glass shields around the cabin 40 by the light emitted from the display screen 30.

Therefore, the operator pushes the brightness changing switch 23 so as to reduce the reflection on the glass shields. As a result, the signal instructing the lower brightness is outputted to the liquid crystal drive device so that the brightness of the display color of the background portion 31 is changed to the "thick light blue" of the lower brightness, as shown in FIG. 1B.

As a result, the reflection of the display screen 30 on the glass shields can be substantially eliminated. Moreover, the brightness of the display screen 30 is not reduced so that the visibility of the display screen 30 is not degraded. Therefore, the operator can retain the field of view at the nighttime to drive the construction machine safely.

If the brightness of the outside of the cabin 40 rises at the daytime but the display color of the background portion 31 on the display screen 30 remains in the low brightness of the "thick light blue", on the other hand, the display color of the background portion 31 and the display colors of the bar graphs 32 and the caution marks 33 on the display screen 30 become visibly poor in the brightness difference (or contrast) so that the bar graphs 32 and the caution marks 33 on the display screen 30 are hard to observe.

Therefore, the operator pushes the brightness changing switch 23 so that the bar graphs 32 and the caution marks 33 on the display screen 30 may be easily observed. As a result, the signal instructing the higher brightness is outputted to the liquid crystal display device to change the brightness of the display color of the background portion 31 into the "thin light blue" of the higher brightness, as shown in FIG. 1A.

As a result, the brightness difference (or contrast) between the display color of the background portion 31 and the display color of the bar graphs 32 and the caution marks 33 on the display screen 30 becomes satisfactory in the visibility so that the bar graphs 32 and the caution marks 33 on the display screen 30 can be easily observed.

Here in this embodiment, the display color of the background portion 31 is changed by pushing the brightness changing switch 23. However, the brightness of the background portion 31 on the display screen 30 may be changed not by providing the brightness changing switch 23 but in association with the illumination switch 45 shown in FIG. 3.

At the nighttime, more specifically, when the indicator 45*a* of the illumination switch 45 is controlled from the first switch position 46 to the second switch position 47, the floodlight of the monitor panel 10 is turned ON to illuminate the monitor panel 10. When the indicator 45*a* of the illumination switch 45 is controlled to indicate the third switch position 48, on the other hand, the headlight and the working light of the construction machine are turned ON along with the illumination of the monitor panel 10. Associatively as the indicator 45*a* of the illumination switch 45 is controlled to indicate the second switch position 47 from the first switch position 46, the signal instructing the lower brightness is outputted to the liquid crystal display device so that the brightness of the display color of the background portion 31 is changed to the "thick light blue" of the lower brightness, as shown in FIG. 1B. Here, the brightness may be changed associatively as the indicator 45*a* of the illumination switch 45 is controlled to indicate the third switch position 48.

When the indicator 45*a* of the illumination switch 45 is controlled at the daytime to indicate the first switch position 46 from the second or third switch position 47 or 48, the illumination switch is turned OFF so that the monitor panel 10 of the cabin 40 is not illuminated. Associatively with this, the signal to instruct the higher brightness is outputted to the liquid crystal display device so that the brightness of the display color of the background portion 31 is changed to the "thin light blue" of the higher brightness.

On the other hand, the brightness of the display color of the background portion 31 may be changed not manually but automatically.

For example, the cockpit 40 of the construction machine is provided inside or outside thereof with a brightness sensor. This brightness sensor can be exemplified by an optical sensor.

When the illuminance detected by the illumination sensor becomes lower in this case than a predetermined threshold value, the signal instructing the lower brightness is outputted to the liquid crystal display device. When the illuminance detected by the illumination sensor exceeds a predetermined threshold value, on the other hand, the signal instructing the higher brightness is outputted to the liquid crystal display device.

At the nighttime when the illuminance detected by the illumination sensor is lower than the predetermined threshold value, therefore, the signal instructing the lower brightness is outputted to the liquid crystal display device so that the brightness of the display color of the background portion 31 is changed to the "thick light blue" of the lower brightness, as shown in FIG. 1B.

At the daytime when the illuminance detected by the illumination sensor is higher than the predetermined threshold value, on the other hand, the signal instructing the higher brightness is outputted to the liquid crystal display device so that the brightness of the display color of the background portion 31 is changed to the "thin light blue" of the higher brightness, as shown in FIG. 1A.

In the embodiment thus far described, the brightness is changed according to the illuminance of the outside of the cabin 40. However, the brightness may be changed responsively as the construction machine becomes abnormal.

When it is detected that the construction machine is abnormal, the caution mark 33 corresponding to the abnormal content is lit. Associatively as this caution mark is lit, moreover, the signal to instruct the lower brightness is outputted to the liquid crystal display device. Where no abnormality is detected in the construction machine, the signal to instruct the higher brightness is outputted to the liquid crystal display device.

When it is detected that the construction machine is abnormal, therefore, the caution mark 33 corresponding to the abnormal content is lit. In response to this lighting, the signal to instruct the lower brightness is outputted to the liquid crystal display device so that the brightness of the display color of the background portion 31 is changed to the "thick light blue" of the lower brightness, as shown in FIG. 1B.

Where it is detected that the construction machine is not abnormal, on the other hand, the signal to instruct the higher brightness is outputted to the liquid crystal display device so that the brightness of the display color of the background portion 31 is changed to the "thin light blue" of the higher brightness, as shown in FIG. 1A.

Thus, the brightness of the display color of the background portion 31 of the display screen 30 is changed from the brightness different from that at the time when the abnormality is not detected.

At an abnormal time, according to this embodiment, the display color of the background portion 31 occupying most of the display area of the display screen 30 changes in the brightness. As compared with the case in which only the caution mark 33 occupying the small area of the display screen 30 is lit, therefore, the operator can recognize the abnormality quickly. As a result, a quick action can be taken on the abnormality of the construction machine while exerting no adverse affect on the construction machine.

If the difference between the brightness of the caution mark 33, as lit, and the brightness of the surrounding background portion 31 is made so as to clarify the caution mark 33, on the other hand, the operator can recognize the abnormality more quickly from the screen 30.

If a different brightness is made to correspond to the kinds of abnormalities, on the other hand, the abnormal content can be discriminated according to the brightness.

Where the abnormality is informed by changing the brightness of the background portion 31, it is possible to omit the arrangement of the caution marks 33.

Figure 4:
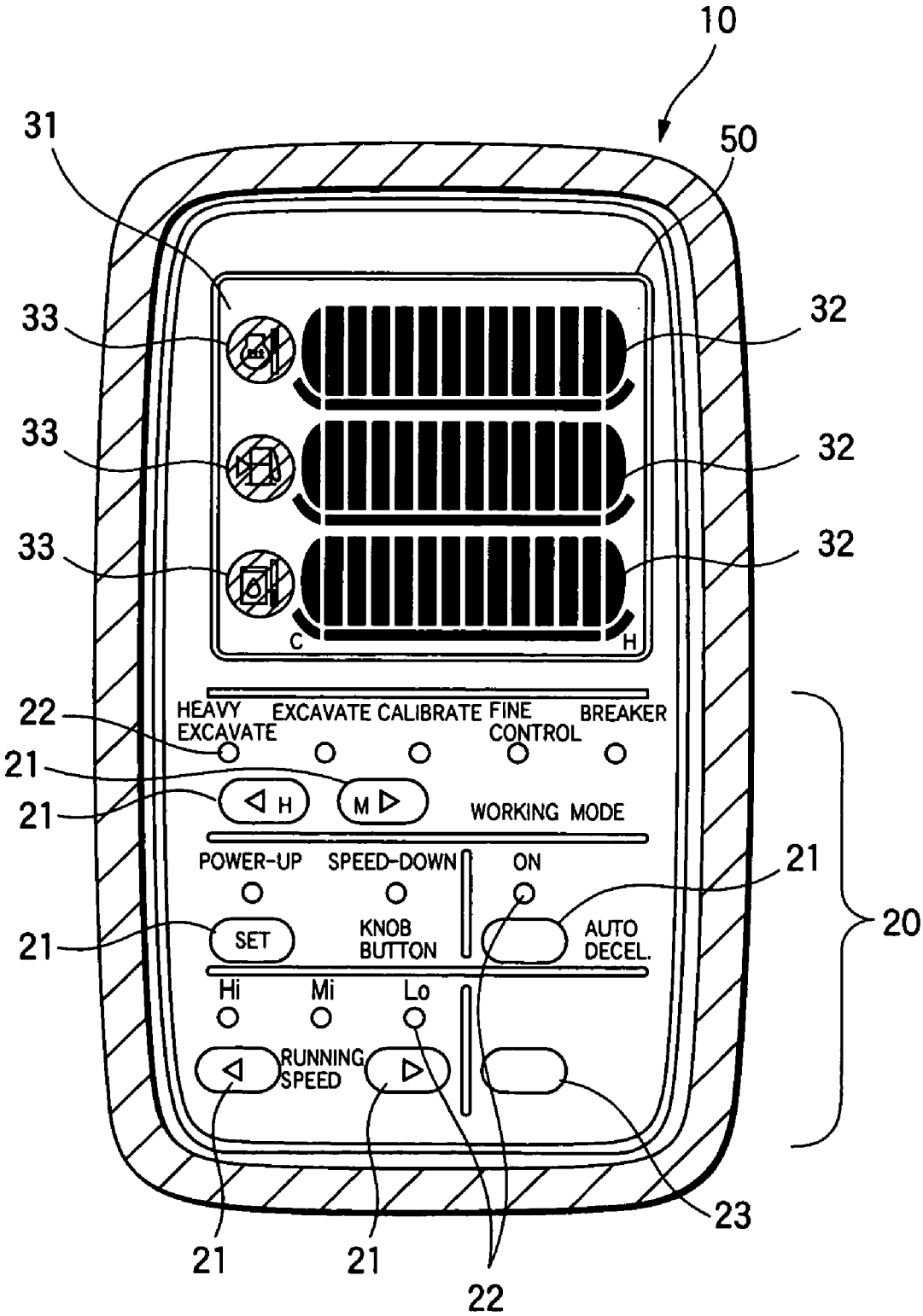
FIG. 4 is a diagram showing the exterior of a monitor panel of an embodiment other than that of FIG. 1.

FIG. 4 is a diagram showing the monitor panel 10 which is provided with a display screen 50 according to a second embodiment. The description of the same components as those of the monitor panel of FIG. 1 will be properly omitted by designating them by the common reference numerals.

The monitor panel 10 shown in FIG. 10 can change the brightnesses of the bar graphs 32 and the caution marks 33 of the display screen 50.

The display screen 50 is composed of the background portion 31, the bar graphs 32 and the caution marks 33. Most of the display area of the display screen 50 is occupied by the bar graphs 32 and the caution marks 33. The display screen 50 has a function to display a plurality of colors and the brightness of the screen. For the display screen 50, there can be used the dot-matrix LCD (or dot-matrix type Liquid Crystal Display), the EL (or Electro-Luminescence) or the LED (or Light Emitting Diode).

In the display screen 50, the display area of the bar graphs 32 and the caution marks 33 is larger than that of the background portion 31 so that the most of the display area of the display screen 50 to be reflected on the glass shields is occupied by the bar graphs 32 and the caution marks 33. At the second embodiment, therefore, there are changed the brightnesses of the bar graphs 32 and the caution marks 33. In this case, the brightness of the bar graphs 32 can also be exclusively changed. Where the caution marks 33 occupy most of the display area of the display screen 30, the brightness of only the caution marks 33 may be arbitrarily changed.

Irrespective of the sizes of the display area of the background portion 31 and the display areas of the bar graphs 32 and the caution marks 33, on the other hand, the brightness of the display color of the background portion 31 may be arbitrarily changed. This is because the bar graphs 32 and the caution marks 33 themselves may become hard to observe if the brightnesses of the display colors of the bar graphs 32 and the caution marks 33 are changed. In the case of many display colors of the bar graphs 32 and the caution marks 33, on the other hand, the control is complicated for changing the brightnesses of the display colors. By changing the brightness of the background portion 31 having a small number of display colors, the controls are facilitated for changing the brightnesses of the display colors.

In the embodiments thus far described, on the other hand, any of the background portion 31, the bar graphs 32 and the caution marks 33 of the display screen 30 is changed in brightness.

In the invention, however, it is not prohibited to change the brightness of the display screen 30, i.e., the brightnesses of both the background portion 31, and the bar graphs 32 and the caution marks 33.

On the other hand, the foregoing embodiments have been described assuming that the brightness of the display color of the background portion 31 or the bar graphs 32 and the caution marks 33 is changed at the two stages. However, the brightness of the display color may be freely adjusted by the operator.

On the other hand, the foregoing embodiments have been described assuming that what is displayed on the display screen 30 is the background portion 31, the bar graphs 32 and the caution marks 33. However, the display on the display screen 30 should not be limited to the background portion 31, the bar graphs 32 and the caution marks 33 but can be applied to any item if this item can be displayed.

Here, the foregoing embodiments have been described assuming that the brightness is changed of the three primaries of colors. By changing the saturation or hue of the display color, however, it is also possible to change the difference in the saturation or the difference in the hue between the background portion 31, and the bar graphs 32 and the caution marks 33.

What is claimed is:

1. A display device disposed in a cabin of a construction machine, which comprises:

a display screen with a background portion and a display portion, the display portion displaying a current status of the construction machine, the display device displaying at least one color in the background portion thereof and at least one image in the display portion thereof, said at least one color displayed in said background portion and said at least one image displayed in said display portion respectively having a brightness, saturation and hue; and change means for changing, without user intervention, at least one of the respective brightness, saturation and hue of said at least one color displayed in said background portion relative to the respective brightness, saturation and hue of said at least one image displayed in said display portion.

2. A display device disposed in a cabin of a construction machine according to claim 1, wherein said change means changes one of the following:

(1) the brightness, saturation or hue of said color displayed in said background portion, and (2) the brightness, saturation or hue of one of said color displayed in said background portion and said image displayed in said display portion which occupies a larger area on said display screen.

3. A display device disposed in a cabin of a construction machine according to claim 1, wherein said change means changes the brightness, saturation or hue of said color displayed in said background portion.

4. A display device disposed in a cabin of a construction machine according to claim 1, further comprising:

an illumination switch for turning an illumination on and off, wherein in response to the ON/OFF of said illumination switch, said change means changes one of the following:

(1) the brightness, saturation or hue of said color displayed in the said background portion, (2) the brightness, saturation or hue of said image displayed in said display portion, and (3) the brightness, saturation or hue of one of said color displayed in said background portion and said image displayed in said display portion which occupies a larger area on said display screen.

5. A display device disposed in a cabin of a construction machine according to claim 1, wherein said change means changes the brightness, saturation or hue of said color displayed in said background portion and said image displayed in said display portion at the same time.

6. A display device disposed in a cabin of a construction machine, which comprises:

a display screen with a background portion and a display portion, the display portion displaying a current status of the construction machine, the display device displaying at least one color in the background portion thereof and at least one image in the display portion thereof, said at least one color displayed in said background portion and said at least one image displayed in said display portion respectively having a brightness, saturation and hue;

illuminance detecting means for detecting illuminance inside or outside of the cabin; and change means for changing, without user intervention, at least one of the respective brightness, saturation and hue of said at least one color displayed in said background portion relative to the respective brightness, saturation and hue of said at least one image displayed in said display portion, depending on whether the illuminance detected by said illuminance detecting means is higher or lower than a predetermined threshold value.

7. A display device disposed in a cabin of a construction machine according to claim 6, wherein said change means changes the brightness, saturation or hue of said color displayed in said background portion and said image displayed in said display portion at the same time.

* * * * *